US008028461B2

(12) United States Patent
NuDyke

(10) Patent No.: US 8,028,461 B2
(45) Date of Patent: Oct. 4, 2011

(54) SWITCH FOR THE CONTROL OF WEAPON MOUNTED ELECTRONIC ASSEMBLIES, A WEAPON HAVING A CONTROL SWITCH AND A METHOD FOR USING WEAPON

(75) Inventor: Richard NuDyke, Van Nuys, CA (US)

(73) Assignee: Patricia NuDyke, Valley Glen, CA (US)

( * ) Notice: Subject to any disclaimer, the term of this patent is extended or adjusted under 35 U.S.C. 154(b) by 1011 days.

(21) Appl. No.: 11/820,051

(22) Filed: Jun. 18, 2007

(65) Prior Publication Data

US 2009/0307955 A1 Dec. 17, 2009

(51) Int. Cl.
*F41G 1/35* (2006.01)

(52) U.S. Cl. ..... 42/117; 42/142; 42/146

(58) Field of Classification Search ..... 42/117, 42/142, 146

See application file for complete search history.

(56) References Cited

U.S. PATENT DOCUMENTS

| | | | | |
|---|---|---|---|---|
| 2,750,848 | A * | 6/1956 | Boyer | 89/137 |
| 4,003,507 | A * | 1/1977 | Elton | 224/246 |
| 4,069,414 | A * | 1/1978 | Bell | 362/110 |
| 5,177,309 | A * | 1/1993 | Willoughby et al. | 42/115 |
| 5,485,695 | A * | 1/1996 | Glock | 42/117 |
| 5,509,226 | A * | 4/1996 | Houde-Walter | 42/117 |
| 5,787,628 | A | 8/1998 | Teetzel | |
| 6,950,033 | B1 | 9/2005 | Guyre | |

OTHER PUBLICATIONS

Crimson Trace, Owner's manual for LaserGrips, revised Oct. 2008, entire document, www.crimsontrace.com/files/manuals/ctc_manual_universal1.pdf.

* cited by examiner

*Primary Examiner* — Stephen M Johnson
(74) *Attorney, Agent, or Firm* — Cislo & Thomas, LLP; Kelly W. Cunningham, Esq.

(57) ABSTRACT

A switch assembly 16 which is selectively deployed upon a weapon and which normally causes electrical power to be communicated to a visible energy emission assembly 14 from a source of electrical power 90 and which requires positive actions to interrupt such communication.

7 Claims, 12 Drawing Sheets

SWITCH FOR THE CONTROL OF WEAPON MOUNTED ELECTRONIC ASSEMBLIES, A WEAPON HAVING A CONTROL SWITCH AND A METHOD FOR USING WEAPON

GENERAL BACKGROUND

1. Field of the Invention

The present invention generally relates to a switch for the control of weapon mounted electronic assemblies, a weapon having such a control switch and a method for using a weapon and more particularly, to a switch which allows various types of dissimilar electronic assemblies which are operatively attached to and/or mounted upon a weapon to be selectively operated in an efficient and highly desired manner, effective to increase user safety and reduce the likelihood of inadvertent or unintentional injury or death.

2. Background of the Invention

A weapon, such as and without limitation a firearm, may include one or more electronic assemblies, such as a visible energy generating assembly, such as a light. Particularly, these visible energy generating assemblies are generally deployed upon the weapon (e.g., either as "originally provided equipment" or as an aftermarket or "add-on" accessory) in order to allow the user of the weapon to accurately view a person of interest (e.g., be able to identify if a real threat exists). Of course, such visible energy generating assemblies are particularly useful in dark environments in which a threat may not be readily and visually perceived.

While such weapon-mounted visible energy generating assemblies do selectively provide needed light or visible energy, such assemblies suffer from many drawbacks. By way of example and without limitation, these assemblies all require that the weapon user take some "positive action" in order to "switch on" or allow the visible energy emitting assembly to become selectively activated (i.e., the term "activated", in this context, means a state in which the assembly selectively generates visible energy). Such positive action typically manifests itself in the required movement of a switch (such as a rocker switch or shuttle switch or a tape type switch) which causes electrical energy to be communicated to the visible energy emitting assembly, effective to allow the assembly to generate visible energy or to become "activated". Thus, these prior visible energy generating assemblies are normally "deactivated".

The required "positive action" undesirably adds a level of complexity to one who knowingly already faces a dangerous situation. That is, whether used by a soldier, police officer, or a citizen these visible energy emission assemblies are used when a perceived threat is present or potentially present. In the context of the existence of a very real threat, even professionally trained and well-practiced weapon users are hard pressed to skillfully employ the weapon. It is well documented that in such stressful situations, fine motor skills, such as those required to operate a weapon, rapidly deteriorate. Thus, requiring further action on the part of these individuals to energize or actually activate the visible light emission assembly further increases the already complex actions of properly operating the weapon and such additional complexity occurs at a time in which fine motor skills are deteriorating.

Further, since the consequences of failing to properly allow visible energy to be emitted from the visible light emission assembly are oftentimes deadly (e.g., the threat has not been identified in sufficient time to engage it), such increased complexity is very undesirable and actually increases the probability of death or injury to the weapon user or to an innocent or "non-threat" who is not correctly identified, by the weapon user, as a non-threat because of the decision of the weapon user to "shoot first and activate the visible energy emission device later".

Thus, the existing requirement of the weapon user to provide positive motion or action to activate a normally de-energized energy emitting assembly (e.g., one which is normally in the "off" or non-energy emitting state) is undesirable and this undesirability is a common attribute to each of the existing switch assemblies which are currently utilized.

Additionally, many rocker switch implementations have an additional drawback in that they require constant force or pressure in order to allow desired energy to be emitted (i.e., requiring a constant amount of positive action) or require complex movement that requires a user to select one of three states (i.e., the respective states of constant "on", momentary "on" or "off"), each of which is represented by a respectively unique position of the multi-position switch. Such complex operation, as described above, is undesirable and increases the likelihood of death or injury.

Further, the tape type switches generally suffer from additional drawbacks in that they typically comprise a flexible wire conduit which attaches to the body or switch housing of the energy emitting assembly and extend along the underside of a trigger guard of the weapon or firearm until it meets the intersection of the rear of the trigger guard and the top forward portion of the grip of the weapon or firearm (i.e., a front strap). A portion of the flexible wire conduit normally extends down the front strap and terminates in a membrane switch that is located on the front strap.

The placement of the membrane switch on the front strap requires that, in order to allow the weapon, such as a pistol, to be drawn from a holster without activating the energy emission assembly, it must be done only with the two smallest and weakest fingers of the user. This attribute not only compromises the weapon draw but also undesirably impacts the ability to assume a proper grip on the weapon which is critical to shooting accuracy. Further, the membrane switch is immediately adjacent (i.e., the membrane switch is separated from the trigger by about one-quarter of an inch) to the trigger and is operated in the same manner as the trigger (i.e., by a squeezing motion). Thus, it is quite possible that one may accidentally squeeze the trigger (e.g., causing the firing of one or more bullets) when it was intended that only the membrane switch was to be squeezed in order to just to allow visible energy to be emitted. Thus, inadvertent death or injury of an individual may result.

Lastly, the tape type switch implementation is un-aesthetically pleasing and is not fully attached to the weapon, making it prone to "snagging" or damage. Yet further, the pressure switch embodiment provides a dimensional change in the grip area of the weapon and in those situations in which the pressure switch is used only as an "as needed" basis (i.e., attached to the weapon as needed), a user will encounter two distinct grips which add yet further complexity to the overall operation of the weapon and makes it difficult for a user to obtain a "consistent" grip on the weapon.

The present invention overcomes these and other disadvantages and drawbacks of prior and currently utilized weapon switches in a new and novel manner.

SUMMARY OF THE INVENTION

It is a first non-limiting object of the present invention to provide a weapon switch which allows for a weapon mounted energy emission assembly to be selectively controlled in a desired manner which overcomes some or all of the previously delineated drawbacks of prior and existing switches.

It is a second non-limiting object of the present invention to provide a weapon switch which includes a new and improved switch assembly which overcomes some or all of the previously delineated drawbacks of prior weapon switches, such as by way of example and without limitation those which are set forth above.

It is a third non-limiting object of the present invention to provide a method for using a weapon which overcomes some or all of the drawbacks which have been delineated above.

It is a fourth non-limiting object of the present invention to provide a visible energy emission switch assembly which allows visible energy to normally emanate from a weapon unless and until some positive action is accomplished.

It is a fifth non-limiting object of the present invention to provide a method for using a weapon in which light normally emanates from the weapon whenever the weapon is taken out of a holster.

According to a first non-limiting aspect of the present invention, a weapon switch is provided and includes a spring-loaded lever, which causes an electrical circuit to be completed such that energy is radiated.

According to a second non-limiting aspect of the present invention, a weapon switch assembly is provided and includes a body portion; a first portion which is selectively coupled to a source of electrical power; a second portion which is selectively coupled to a selectively energizable light source, which is selectively movable within the body portion, which is normally and communicatively biased against the first portion, effective to normally and communicatively allow electrical power to be communicated to the selectively energizable light from the source of electrical power, effective to normally activate the selectively energizable light, wherein the second portion is selectively movable to a second position in which the communication of the electrical power to said selectively energizable light is interrupted, thereby preventing the energization of the selectively energizable light.

According to a third non-limiting aspect of the present invention, a firearm is provided and includes a projectile firing portion; a selectively activatable light which is coupled to the firing portion; a power source; and a selectively movable assembly which is coupled to the power source and to the selectively activatable light and which is selectively movable from a first position in which the switch allows the power source to be coupled to a selectively activatable light, thereby allowing the light to be selectively activated, to a second position in which the switch interrupts the coupling of the power source to the selectively activatable light and wherein the switch normally occupies the first position until it is forcibly moved to the second position.

According to a fourth non-limiting aspect of the present invention, a firearm having a projectile firing portion is provided and includes a trigger and a surface; a selectively activatable energy emitter which is coupled to the projectile firing portion; a source of energy; a switch portion which is coupled to the surface of the firearm and which includes a selectively movable lever which is positioned proximate to the trigger and which normally and orthogonally extends away from the barrel and which is movable from a first position to a second position and wherein the switch portion is coupled to the source of energy and to the energy emitter and when the selectively movable lever is in the first position, the source of energy is coupled to the selectively automatable energy emitter, thereby causing the emitter to generate visible energy, and when the selectively movable lever is selectively moved to the second position, the coupling of the source of energy to the emitter is interrupted, thereby preventing the emitter from generating the visible energy; and a disable switch which is coupled to the switch portion and which prevents the energy emitter from being coupled to the source of energy regardless of the position of the lever.

According to a fifth non-limiting aspect of the present invention, a method of using a firearm is provided and includes the steps of providing a selectively energizable light assembly; mounting the selectively energizable light assembly upon the firearm; and causing the selectively energizable light assembly to generate light unless force is applied to the weapon switch.

According to a sixth non-limiting embodiment, a method of using a firearm is provided and includes the steps placing a visible energy emission assembly upon the firearm; providing a switch; providing a source of power; coupling the switch to the visible energy emission assembly and to the source of power; causing the switch to allow said source of power to be coupled to the visible energy emission assembly unless and until a portion of the switch is depressed; providing a holster; placing the firearm within the holster and causing the portion of the switch to be depressed when the firearm is in the holster and to be released when the firearm is removed from the holster, hereby causing visible energy to be automatically emitted from the emission assembly when the firearm is removed from the holster and causing no visible energy from being emitted from the emission assembly when the firearm resides within the holster.

According to a seventh non-limiting embodiment of the invention, a method of using a firearm is provided and includes the steps placing a visible energy emission assembly upon the firearm; providing a switch having a selectively movable lever; providing a source of power; coupling the switch to the visible energy emission assembly and to the source of power; causing the switch to normally allow said source of power to be coupled to the visible energy emission assembly; providing a holster; placing the firearm within the holster such that the lever portion of the switch to be depressed when the firearm is in the holster; and allowing the lever to be captured by the user's trigger finger upon drawing the firearm from the holster, hereby preventing visible energy from being emitted from the emission assembly when the firearm is not within the holster, thereby allowing for a stealth draw.

According to an eight non-limiting embodiment of the invention, a method of using a firearm is provided and includes the steps of placing a visible energy emission assembly upon the firearm; providing a switch having a selectively movable lever; providing a source of power; coupling the switch to the visible energy emission assembly and to the source of power; causing the switch to allow said source of power to be normally coupled to the visible energy emission assembly absent a movement of said lever; placing the firearm on a surface with the switch engaging said surface, thereby causing the lever portion of the switch to be depressed when the firearm is on the surface and allowing the switch to energize the light emission assembly upon lifting the firearm from the surface, thereby causing visible energy to be emitted from the emission assembly when the firearm is held by the user, thereby allowing for a night stand mode operation.

These and other features, aspects, and advantages of the present invention will become apparent to those of ordinary skill in the art from a reading of the following detailed description of the preferred embodiment of the invention, including the subjoined claims, and by reference to the following drawings.

DETAILED DESCRIPTION OF THE PREFERRED EMBODIMENT OF THE INVENTION

Figure 1:
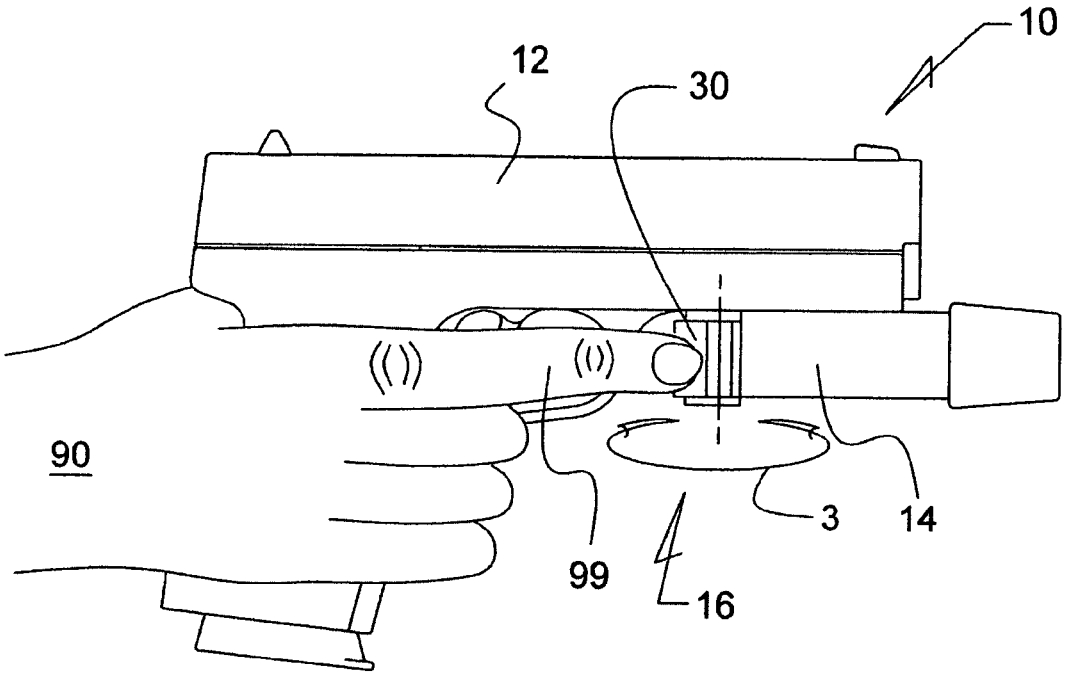
FIG. 1 is a side view of a weapon which includes an energy control switch assembly which is made in accordance with the teaching of the preferred embodiment of the invention and shown being operatively deployed within the hand of a user.
Figure 2:
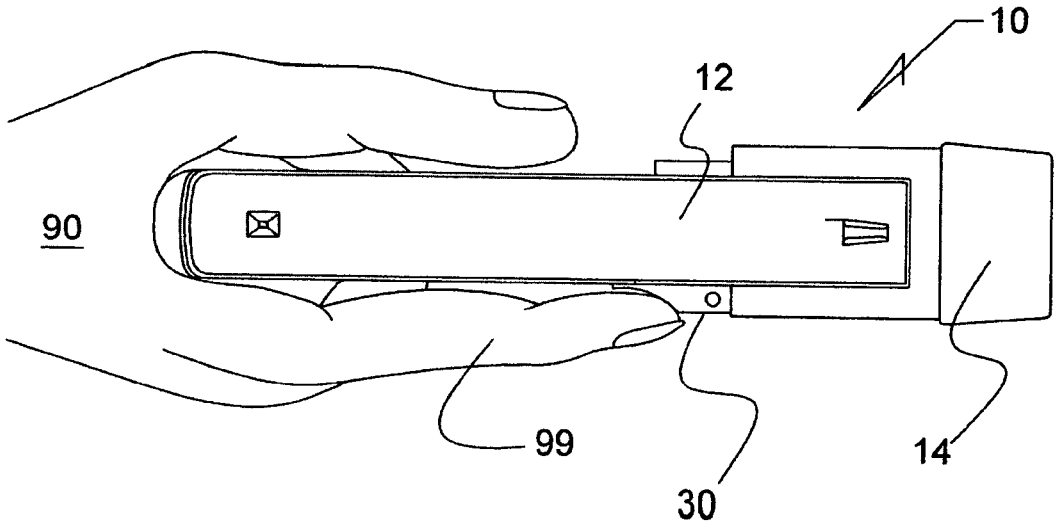
FIG. 2 is a top view of the weapon which is shown in FIG. 1 and further begin shown as being operatively deployed within the hand of a user.
Figure 3:
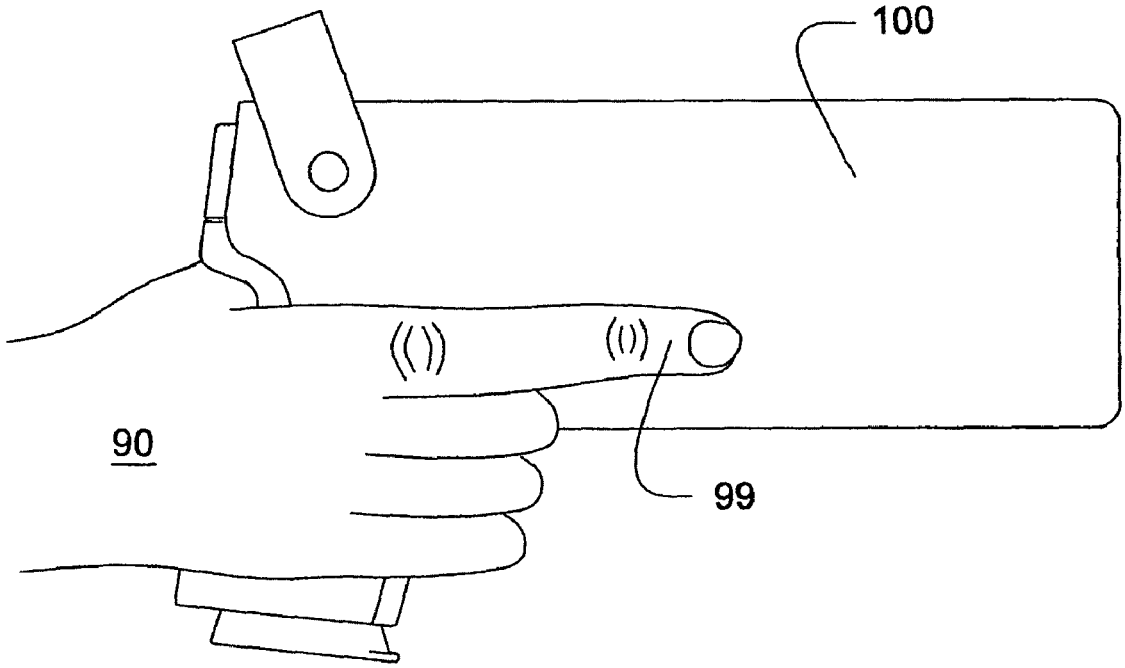
FIG. 3 is a side view of the weapon which is shown in FIGS. 1 and 2 but being deployed within a holster and held in the hand of an individual.
Figure 4:
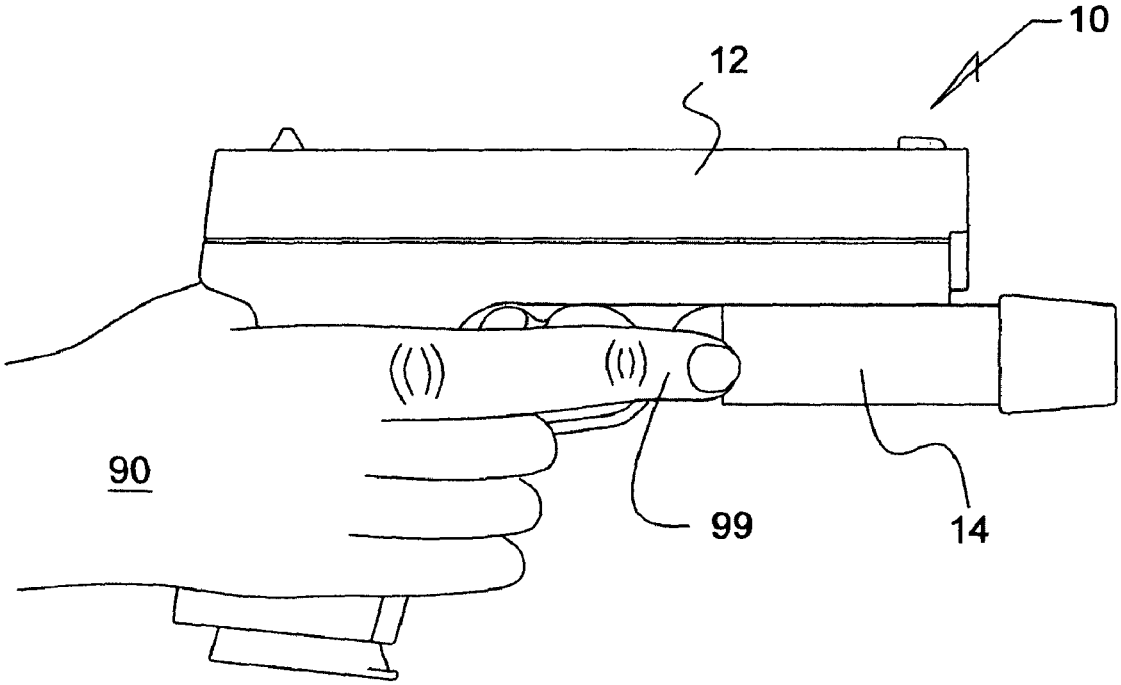
FIG. 4 is a side view of the weapon which is shown in FIG. 3 after it has been removed from the holster.

Referring now to FIGS. 1 and 2, there is shown a weapon 10 which is made in accordance with the teachings of the preferred embodiment of the invention. Particularly, while weapon 10, in FIGS. 1 and 2 generally comprises a pistol, it should be appreciated that the current inventions are not limited to any particular type of weapon or firearm (e.g., in this application these terms "weapon" and "firearm" are used synonymously to mean any device or assembly which selectively emits a projectile or other type of potentially harmful emission). Rather, the inventions are applicable to substantially any type of weapon or firearm and that the pistol which is depicted within the various drawings are done so for illustrative purposes only.

Further, as shown, the weapon 10 includes a barrel or projectile directing or emission portion 12 upon which is contained a visible energy emission portion 14 (e.g., such as a selectively activatable light assembly) and the visible energy emission portion 14 includes a weapon switch or switch assembly 16 having a selectively depressible or movable lever 30 which is made in accordance with the teachings of the preferred embodiment of the invention.

It should be appreciated that the weapon 10, except for the addition of the switch assembly 16 and perhaps with the addition of the visible energy emission portion 14, may comprise a conventional and commercially available pistol. Some conventional firearms may have as an "add-on" accessory the assembly 14 or may include the visible energy emission assembly 14 (i.e., be actually produced at a factory with such an assembly 14).

It should be further appreciated that the visible energy emission portion 14 may comprise a selectively energizable light assembly, which may be commercially available and, by way of example and without limitation, may comprise a Surefire® model X200 light emission assembly. Thus, at the outset it should be appreciated that the switch assembly 16 may be used with existing weapons (e.g., those having a visible energy emission assembly) and may thus be selectively and operatively coupled to existing weapon visible light emission assemblies, such as the Surefire® model X200 which then may be operatively deployed upon a weapon. That is, the switch assembly 16 may be provided as "original equipment: (i.e., from the factory) with the weapon 10 or placed upon the weapon 10 in an "aftermarket" application. This non-limiting embodiment may therefore represent a "retrofit" application in which switch assembly 16 is made to be operatively coupled to an existing firearm which includes (e.g., which has an accessory or an integral part thereof) a visible energy emission assembly. Alternatively, the invention may equally comprise the combination of the switch assembly 16 and a new and improved visible energy emission assembly 14 and some non-limiting examples of such a visible energy emission assembly 14 may comprise an infrared emission assembly or substantially any other desired assembly which emits visible energy.

Figure 5:
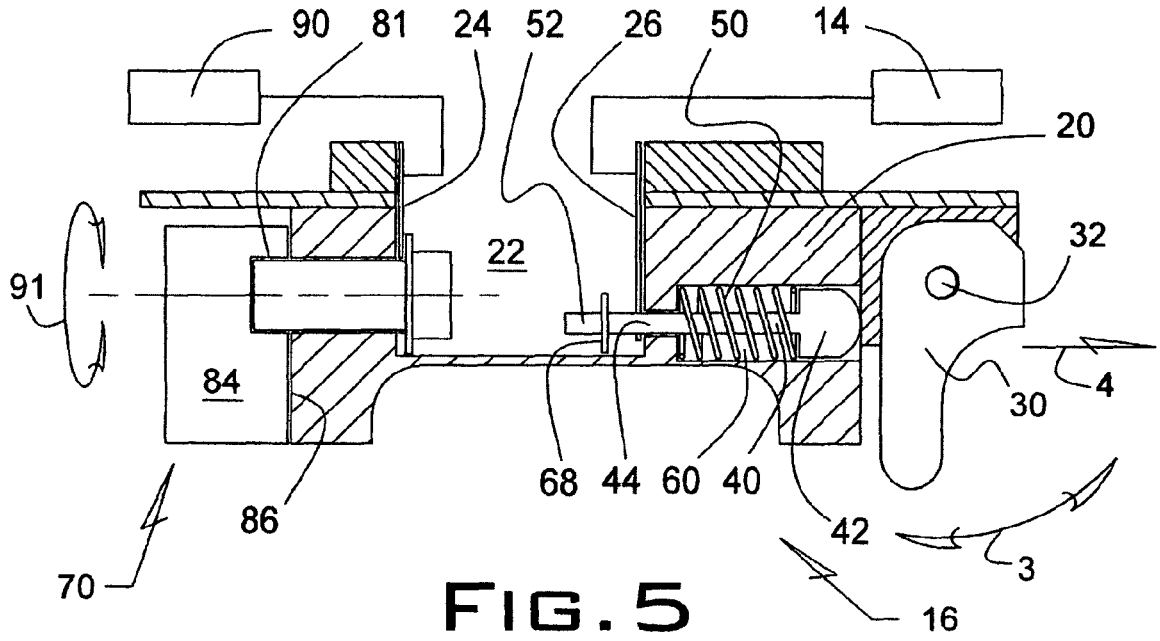
FIG. 5 is a top sectional view of the energy emission control switch assembly which is shown in FIGS. 1-4.
Figure 6:
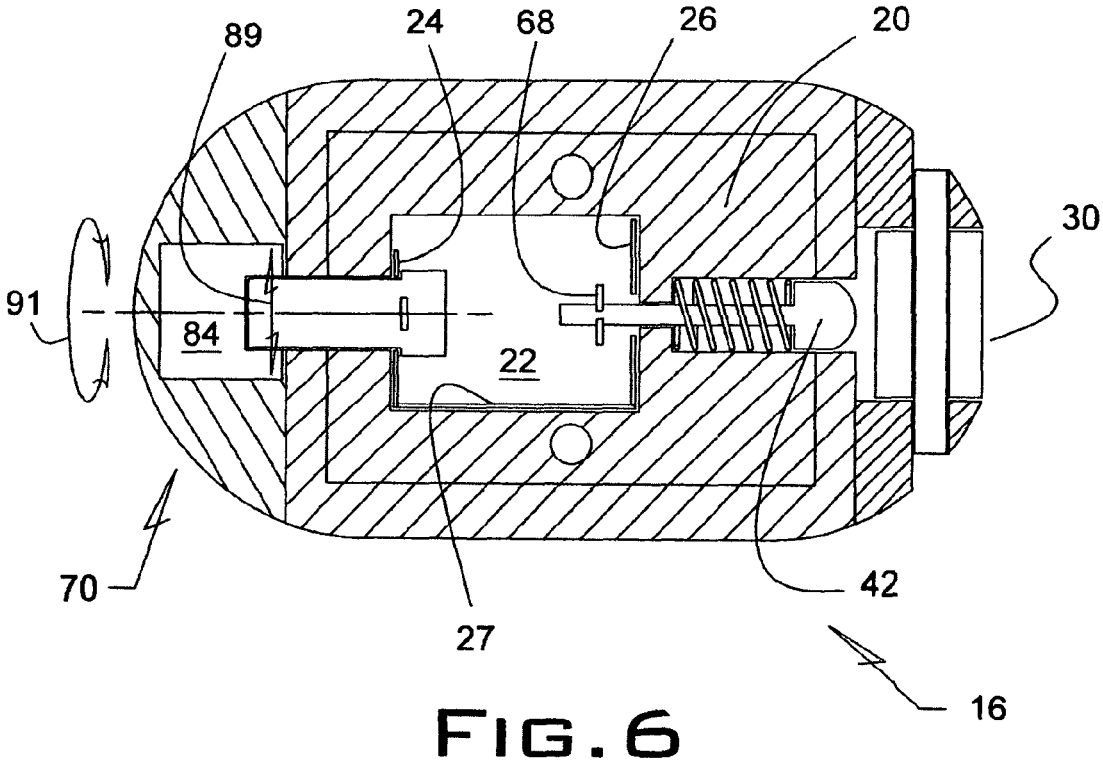
FIG. 6 is a rear sectional view of the energy emission control switch assembly which is shown in FIGS. 1-5.

To understand the operation of the switch assembly 16 and the visible energy emission portion 14, reference is now made to FIGS. 5-11. Particularly, as shown, the switch assembly 16 includes a switch body 20 having a first interior "central" cavity 22 which includes electrically conductive and spaced apart material segments 24, 26, 27 (e.g., each of which may respectively comprise copper or substantially any other desired type of electrically conductive material). As shown in FIG. 6, material segments 24, 26, and 27 do not physically touch one another.

The switch assembly 16 further includes a selectively movable lever member 30 which is attached to the body 20 by a pin 32 and such attachment allows the lever 30 to selectively pivot about the pin 32 (e.g., pin 32 traverses and is physically embedded within body 20). Importantly, pin 32 allows lever member 30 to selectively move or "swing" toward and away from the first central interior cavity 22 along arc 3. The switch assembly 16 also includes a second pin 40 having a bulbous shaped head 42 and a shaft portion 44 which integrally terminates into and emanates from the head 42; and a spring 50 which receives the shaft portion 44. In the most preferred embodiment of the invention, the shaft portion 44 traverses the spring 50 and has an end 52 which is disposed within the first internal central cavity 22 (i.e., end 52 is opposite the bulbous shaped head 42). In one non-limiting embodiment of the invention, the spring 50 comprises a compression spring with a force which ranges from about one to about three pounds and resides within a second internal cavity 60 which is formed in the body 20 and the second internal cavity 60 communicates with the first cavity 22. Importantly, the shaft portion 44 lies along a longitudinal axis 45, which passes through both ends of the cavity 60, and the spring 50 (i.e., the force exerted by the spring 50 normally) causes the bulbous shaped head 42 (absent some forced intervention) to be biased in close proximity to the lever member 30.

Figure 8:
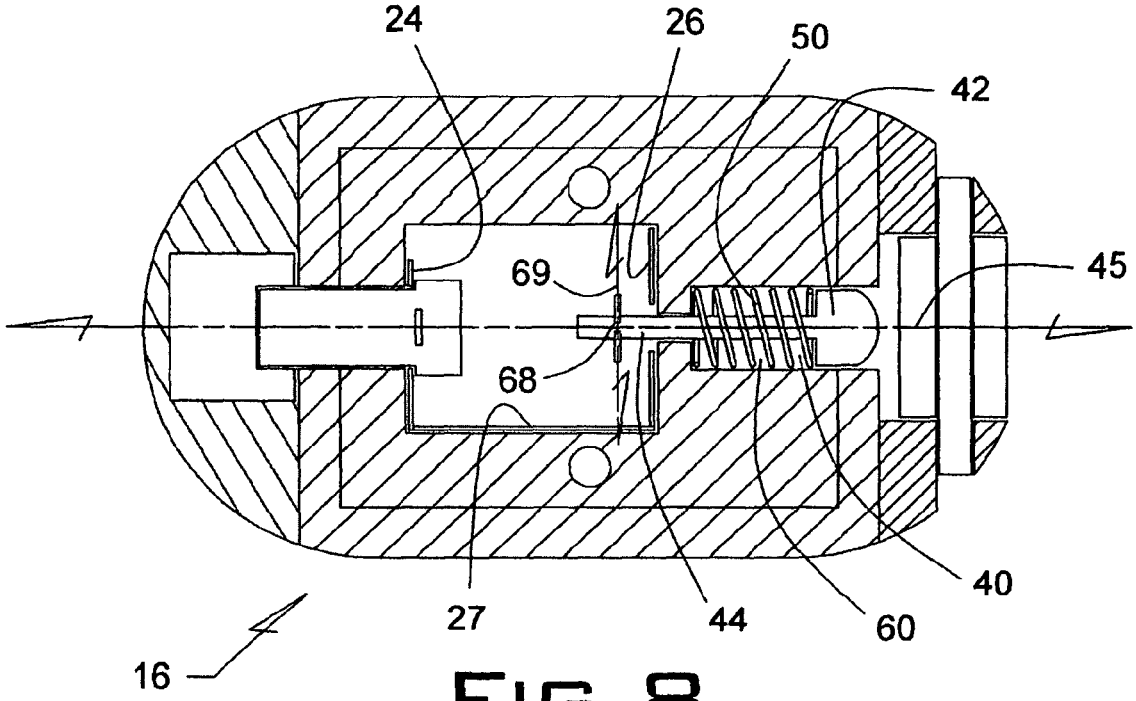
FIG. 8 is a view which is energy emission control switch assembly being in "off" or deactivated position.
Figure 9:
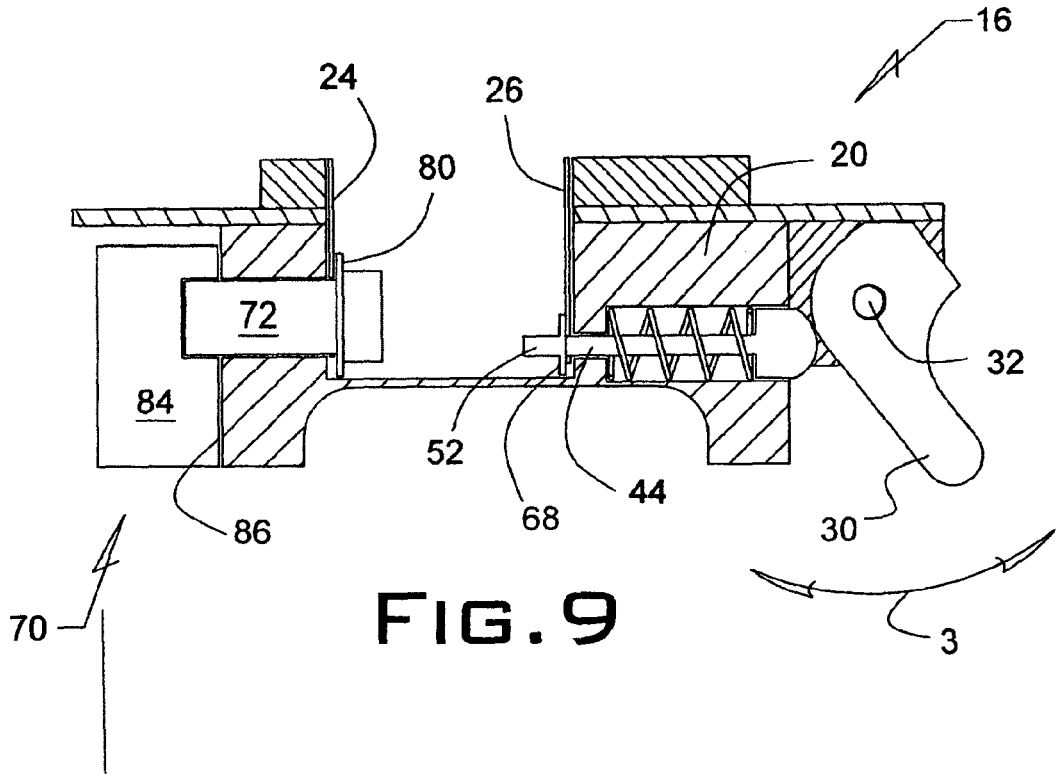
FIG. 9 is a view which is similar to that which is shown in FIG. 5 but in which the energy emission control switch assembly being in the "on" or activated position.

Further, as shown, upon the shaft 44 is placed conductive material 68 (e.g., the conductive material 68 is disposed along an axis 69 which is orthogonal to axis 45) and, in the most preferred embodiment of the invention, the spring 50 is normally positioned, as shown best in FIG. 8, such that conductive material 68 physically touches and is coupled to the conductive material 26 and 27 (e.g., the compression force of the spring 50 normally, in the absence of counter forces created by a user, causes material 68 to physically touch and to actually impinge upon the material segments 26 and 27) and further positions head 42 in close proximity to lever member 30. Particularly, the impingement of the material 68 upon the material segments 26, 27 prevents the force exerted by the spring 50 from causing the pin 40 to exit cavity 60 along direction 4.

The switch assembly 16 further includes, in one non-limiting embodiment of the invention, a disable rotary switch assembly 70 which includes a shaft portion 72 which is disposed within and traverses through a third internal cavity 74 which is formed in the switch body portion 20 and which communicates with cavity 22. Shaft 72 includes conductive material 80 which is attached to and which protrudes from the portion 72 which is operatively and normally deployed within the first cavity 22. The disable switch assembly 70 further includes a second portion 84 which includes a cavity 81 which receives and into which portion 72 may integrally terminate. Particularly, the received portion 72 may selectively rotate within the cavity 81 along arc 91. Portion 84 is operatively deployed on the outermost surface 86 of the body 20.

Figure 7:
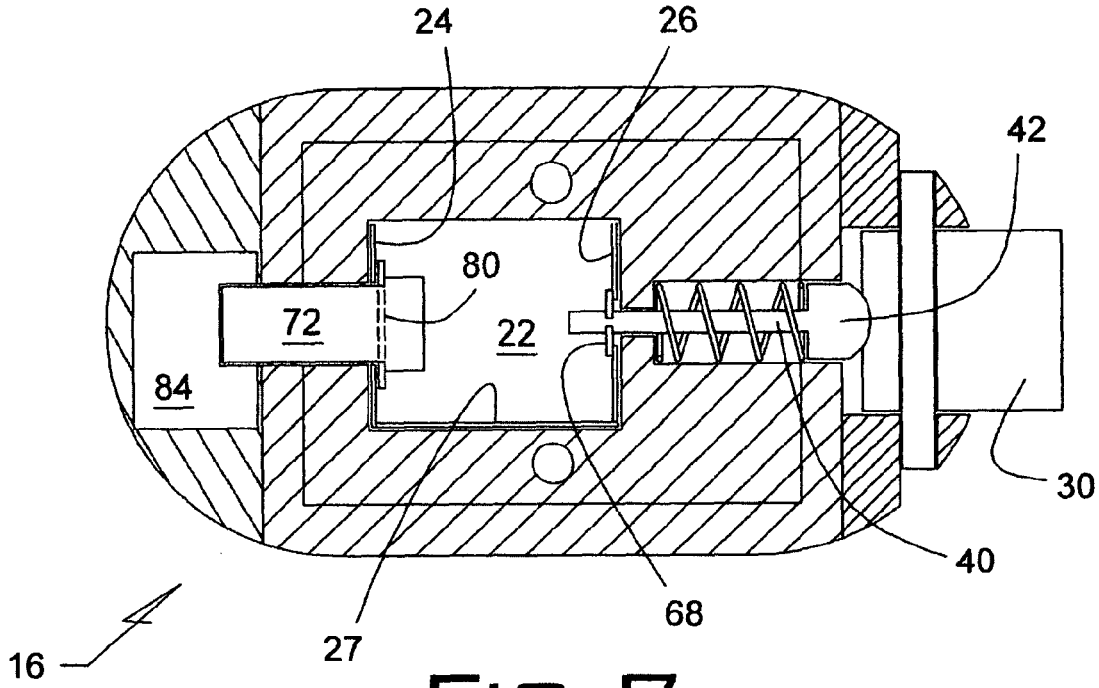
FIG. 7 is a view which is similar to that which is shown in FIG. 6 but in which the energy emission control switch assembly being in the "on" or activated position.

As is shown perhaps best in FIG. 7, the conductive material 80 is physically decoupled or disconnected from material segments 24, 27 when the second portion 84 is placed in a first position (see, for example FIG. 6), thereby preventing the completion of a conductive path by material segments 26, 27, 24. This first position is achieved when, in one embodiment, axis of symmetry 89 of the cavity 81 is made parallel to segment 26. Rotating second portion 84 around arc 91 couples or connects conductive material segments 80, 24, and 27, thereby allowing a full conductive path to be achieved by conductive segments 26, 68, 27, 24, and 80. (See, For example, FIG. 7) In this second position, axis of symmetry 89 is 45 degrees from the axis of symmetry 91 of the first position.

In operation, as best shown in FIG. 7, the spring member 50 compressibly biases the shaft member 44 such that conductive material 68 is physically coupled to conductive material segments 26 and 27 while the portion 72 is positioned such that conductive material 80 is physically coupled to the conductive material segments 24 and 27. Particularly, the conductive material 68 will both retain the shaft 44 against the compressible force of the spring 50 (e.g., by engaging material segment 26), and acts to restrain the spring 50 and shaft 44 within the body 20.

In this manner, electrical power is normally sourced from the battery or other power source 90 to the visible energy emission assembly 14 through the physically coupled conductive materials 68, 80 and the segments 24, 27, and 26 (e.g., an electrical circuit is "completed") and in this manner visible energy, such as light, is normally emitted from the visible energy emission assembly 14 and thus the user of the weapon 10 need not have to perform the "motions" or other types of required positive actions associated with current and prior assemblies which are required to activate the visible energy; rather the visible energy emission assembly 14 is already and normally activated. The battery or power source 90 may also reside within the body 20 of the visible energy emission assembly 14 or attached to the body 20 and be removably connected and removed from the body or the surface of the body 20, and such connection to the surface of body 20 may be made by the use of a conventional connector such as and without limitation a screw or pin. In the event that the user of the weapon 10 determines that visible energy is not desired, then the user would selectively depress or otherwise move the lever 30 along arc 3 in the manner which is shown by way of example and without limitation in FIGS. 8 and 10, thereby ensuring that material 68 does not contact material segments 26 and 27.

That is, to prevent visible energy from being emitted from the visible energy emission assembly 14 (e.g., and from the firearm), the lever 30 is selectively moved against the bulbous shaped head 42 which is effective to move the end 52 further into the cavity 22, thereby interrupting the physical connection of the conductive material 68 from the conductive material segments 26 and 27 and preventing or interrupting electrical power from being sourced from the source of electrical power 90 to the visible energy emission assembly 14.

Moreover, in one non-limiting embodiment of the invention, even when the conductive material 68 is physically coupled to the conductive material segments 26 and 27, such sourcing or communication of electrical energy may be interrupted between the source of electrical power 90 and the assembly 14. That is, the selective movement of the portion 84 of the disable switch 70 to the position where the axis 89 is parallel to segment 26 is effective to cause the conductive material 80 from disengaging from the conductive material segments 26, 27, thereby preventing electrical power or energy from being sourced to the visible energy emission assembly 14 from the source 90. The movement or operation of the disable switch assembly 70 is independent, in one non-limiting embodiment, from the operation of the switch assembly 16, and requires positive action on the part of the user to cause the material 80 from being removed from contact with material segments 26, 27 (i.e., even the disable switch assembly 70 allows energy to flow from source 90 to emission assembly 14 absent some positive action on the part of the user).

Thus, as should be appreciated by reference to FIGS. 3, 4, 14, and 15, since switch assemblies 70 and 16 normally each allow power to flow from source 90 to assembly 14, when the firearm/weapon 10 is selectively and removably placed within a holster, such as holster 100, the inside surface 102 of the holster 100 automatically (e.g., without user intervention) exerts a depressive force against the lever member 30 which counteracts the compression force of the spring 50 and which causes the lever member 30 to move such that material 68 is moved in a "non-contact" relationship with the material segments 26, 27, thereby preventing electrical power from being communicated to the visible energy emission assembly 14 from the power source 90. Hence, visible energy is "automatically" (e.g., without user intervention) prevented from being emitted from the assembly 14 when the weapon is placed in the holster 100.

When the weapon 10 is removed from the holster 100, at some point in time during the removal procedure, the surface 102 is no longer in a "contact relationship" with lever 30 (see, for example, FIG. 15), thereby allowing the compression force exerted by the spring 50 to automatically (e.g., without user intervention) move the lever 30 away from the cavity 22 and allowing material 68 to physically contact material segments 26, 27. In this manner, visible energy (e.g., light) is automatically (e.g., without user intervention) emitted from the assembly 14 when the weapon 10 is removed from the holster 100.

Figure 20:
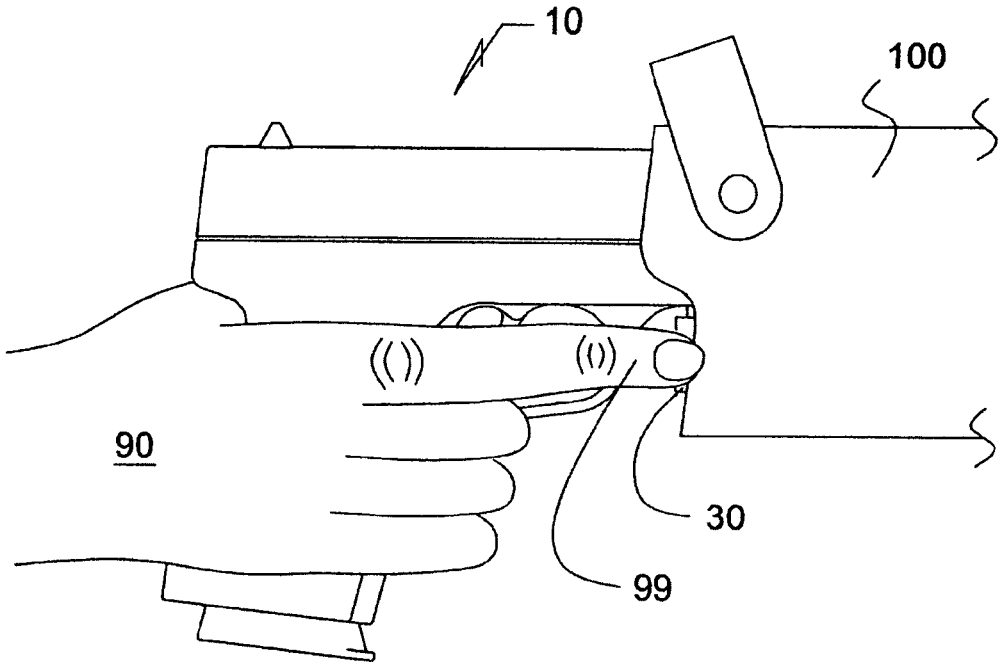
FIG. 20 is a side view of a weapon which includes an energy emission control switch assembly and which is shown in FIGS. 1-10 and which is shown as being removed from a holster to provide for a "stealth draw"

In an alternate and non-limiting embodiment of the invention, as best shown in FIG. 20, drawing the firearm 10 from the holster 100, by hand 90 of a user, allows the lever 30 to be captured by the finger 99 and selectively depressed by the user's trigger finger 99, and thereby cause no visible energy to be emitted from the emission assembly 14 when the firearm 10 is retracted from the holster 100, and thereby allowing for a "stealth draw".

Figure 21:
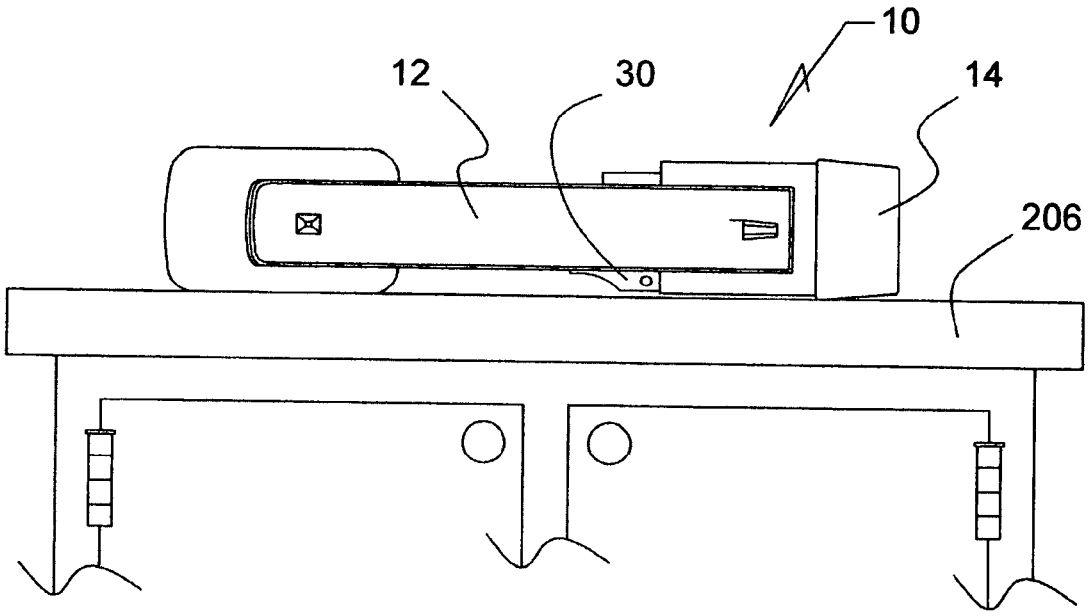
FIG. 21 is a top view of a weapon which is similar to that which is shown in FIG. 1 but in which the weapon is deployed on a surface.

Furthermore, in other non-limiting embodiments, such as that depicted in FIG. 21, placing the firearm 10 on a night stand or similar type of surface 206 causes the lever member 30 to be "automatically" depressed (e.g., by the contact of the surface with the member 30), thereby causing no visible energy to be emitted from the emission assembly 14. However, when the firearm 10 is removed and/or held away from the surface 206, energy is automatically communicated to the light emission assembly (see, e.g. FIG. 15), thereby allowing for a "night stand" mode of operation.

Figure 12:
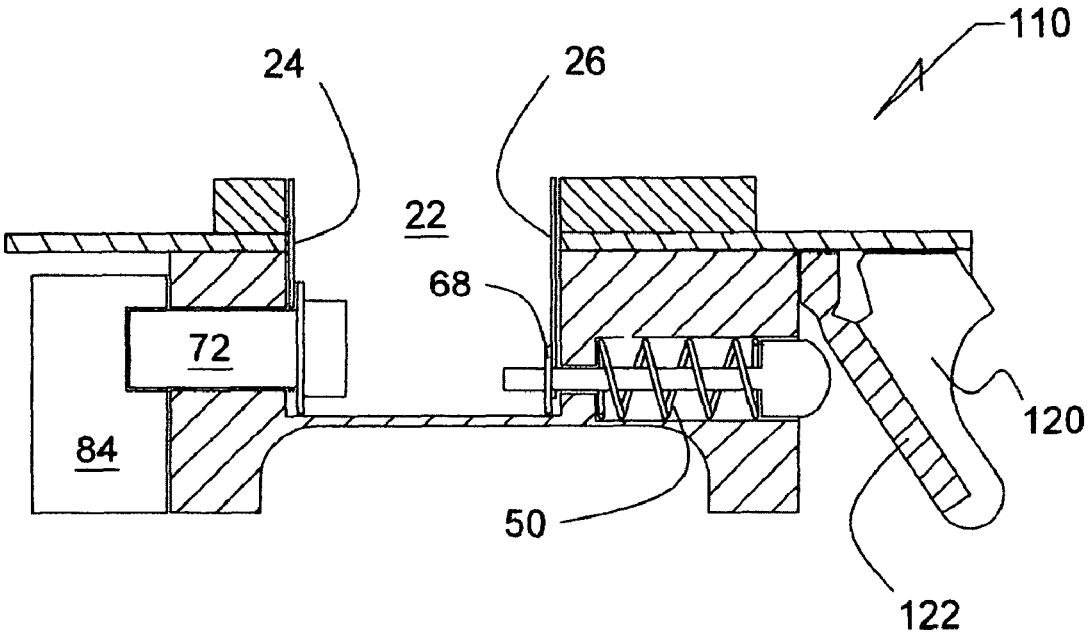
FIG. 12 is a top sectional view of a energy emission control switch assembly which is made in accordance with the teachings of an alternate embodiment of the invention and which is in the "on" or activated state.
Figure 13:
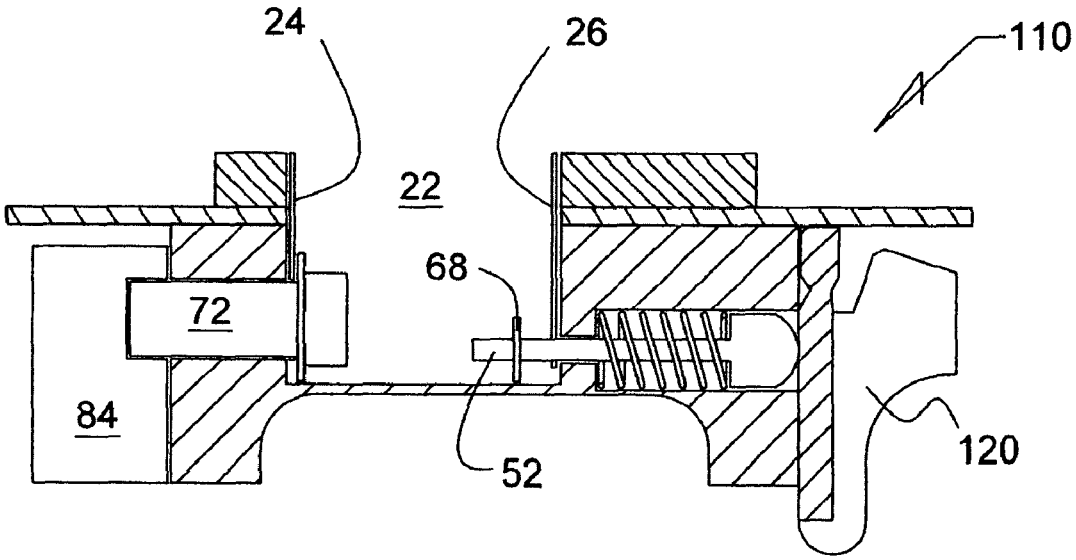
FIG. 13 is a view which is similar to that which is shown in FIG. 12 but in which the energy emission control switch assembly is in the "off" or deactivated state.
Figure 14:
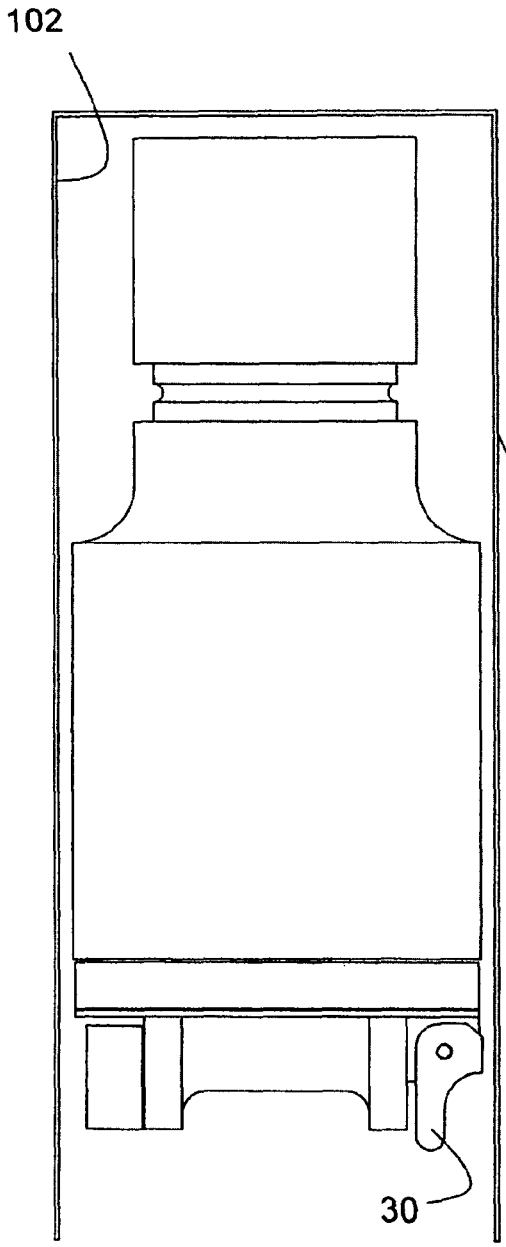
FIG. 14 is a enlarged top view of the combination of a light emission assembly and energy emission control switch assembly as shown in FIGS. 1-10, and which is shown as being fully deployed within the holster.
Figure 15:
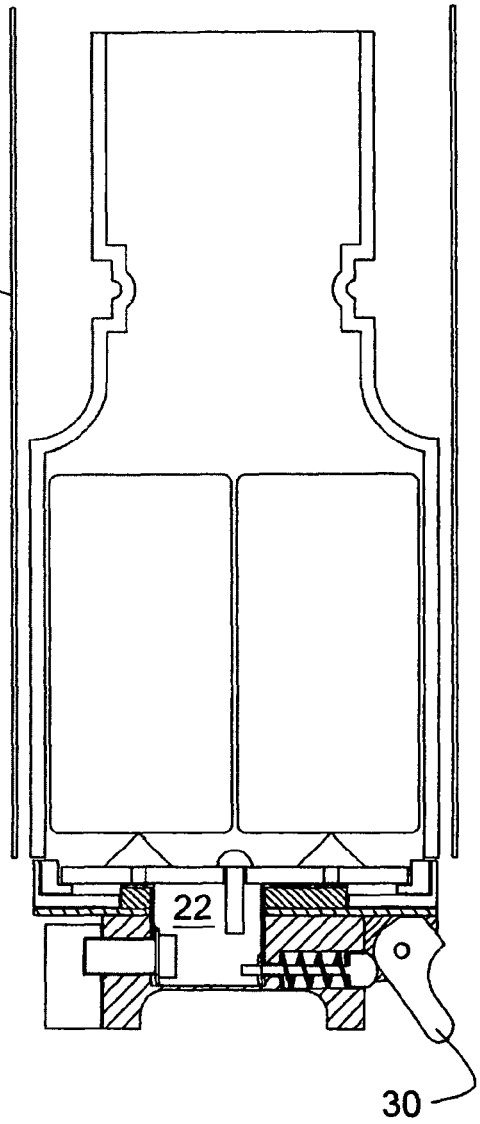
FIG. 15 is a view which is similar to that which is shown in FIG. 14 but in which the combination of the light emission assembly and energy emission control switch assembly is partially removed from the holster.

In other alternate, although non-limiting embodiments, as is best perhaps shown in FIGS. 12, and 13, a "molded self-hinge" 122 is utilized in order to eliminate pin 32.

That is, switch assembly 110 is substantially identical to switch assembly 60 except that pin 32 is not used and lever member 30 is replaced with a lever member 120 which is integrally coupled and/or formed with body 20. The body portion 120 is flexible and selectively movable from a first position (see, for example FIG. 12) in which no substantial counteracting force is exerted on spring 50 (e.g., no force which counteracts the compression force of the spring 50), to a second position (see, for example FIG. 13) in which the shaft end 52 in moved further into the internal cavity 22 and material 68 is made to be in a "non-contact" relationship with material segments 26, 27 in a manner which prevents electrical power from being communicated from the source of electrical power 90 to the visible energy emission assembly 14. This alternate embodiment is less costly than the first described embodiment and is expected to have a longer working life than the previously delineated embodiments due to the creation of relatively low frictional energy. In one embodiment, the portion 120 occupies this second position only during the presence of a constant application of force.

Figure 16:
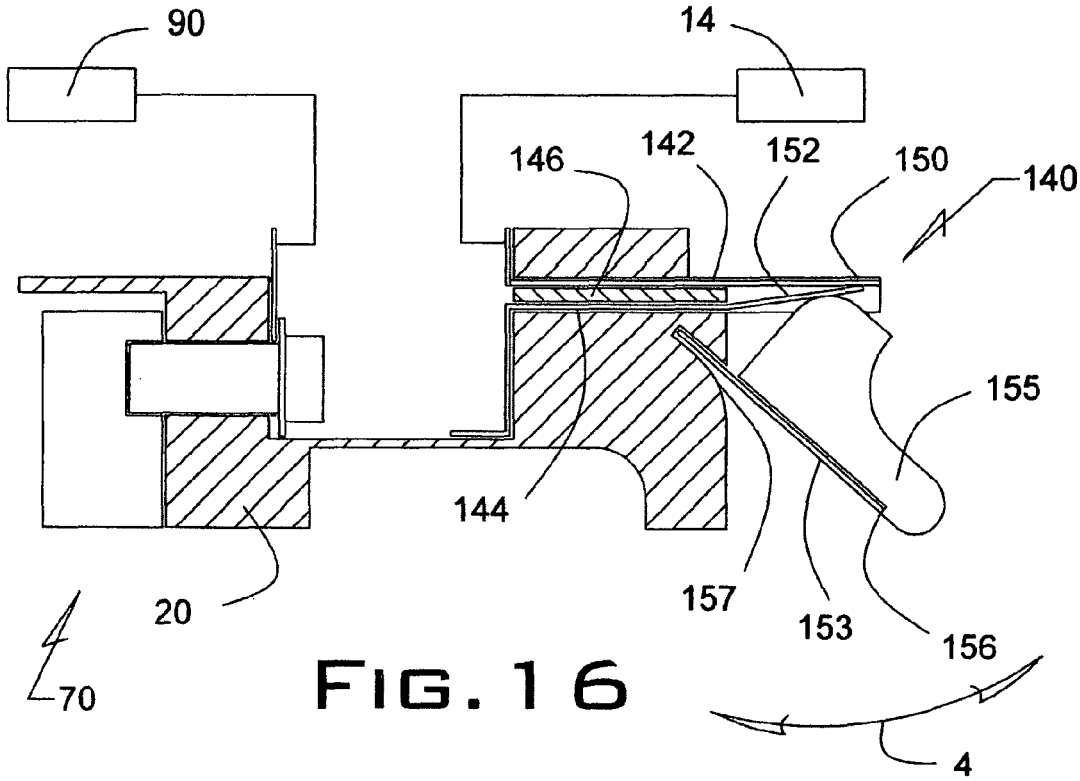
FIG. 16 is a top view of an energy emission control switch assembly which is made in accordance with the teachings of an alternate embodiment of the invention but in which the weapon switch is in the "on" or activated state.

In yet another non-limiting embodiment, the pin 32, lever 30, and shaft 44 are replaced with switch portion 140 (see FIG. 16). Particularly portion 140 comprises a pair of conductive metallic strips, 142, 144, which are separated by an insulating layer of material 146. Particularly, the insulating material 146 does not fully lie between the entire length of the linearly coextensive metallic strips 142, 144 and these strips 142, 144 are coupled to the source of electrical power 90 through conductive segments 24, 26, 27 and material 80, 68 and to the visible energy emission assembly 14.

Figure 10:
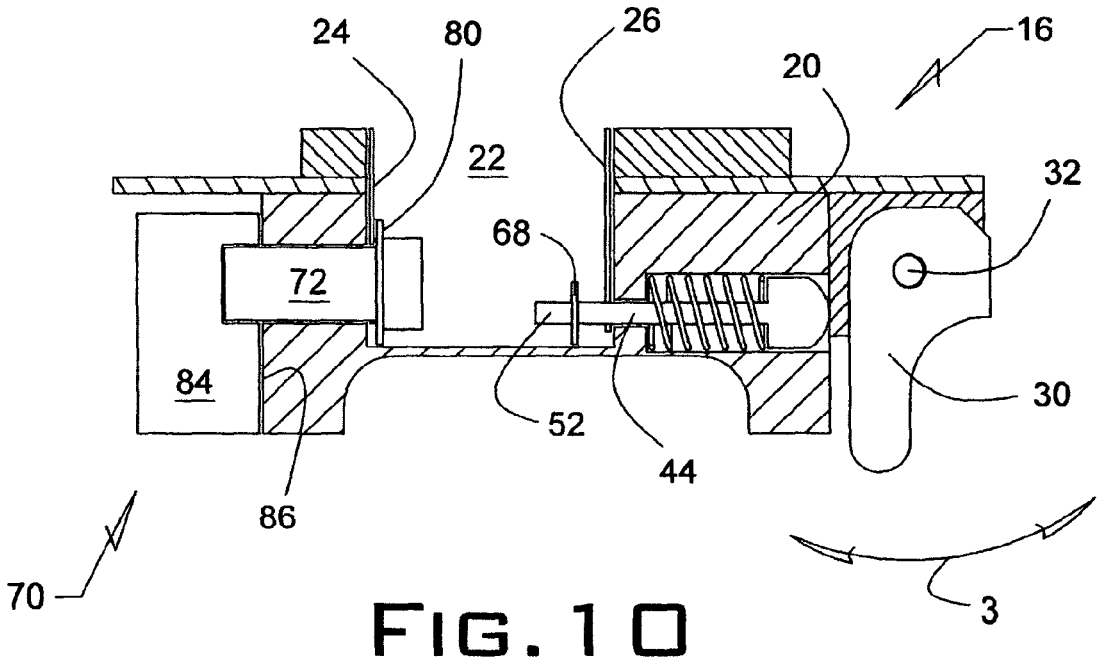
FIG. 10 is a view which is similar to that which is shown in FIG. 9 but in which the energy emission control switch assembly is in the "off" or deactivated position.
Figure 11:
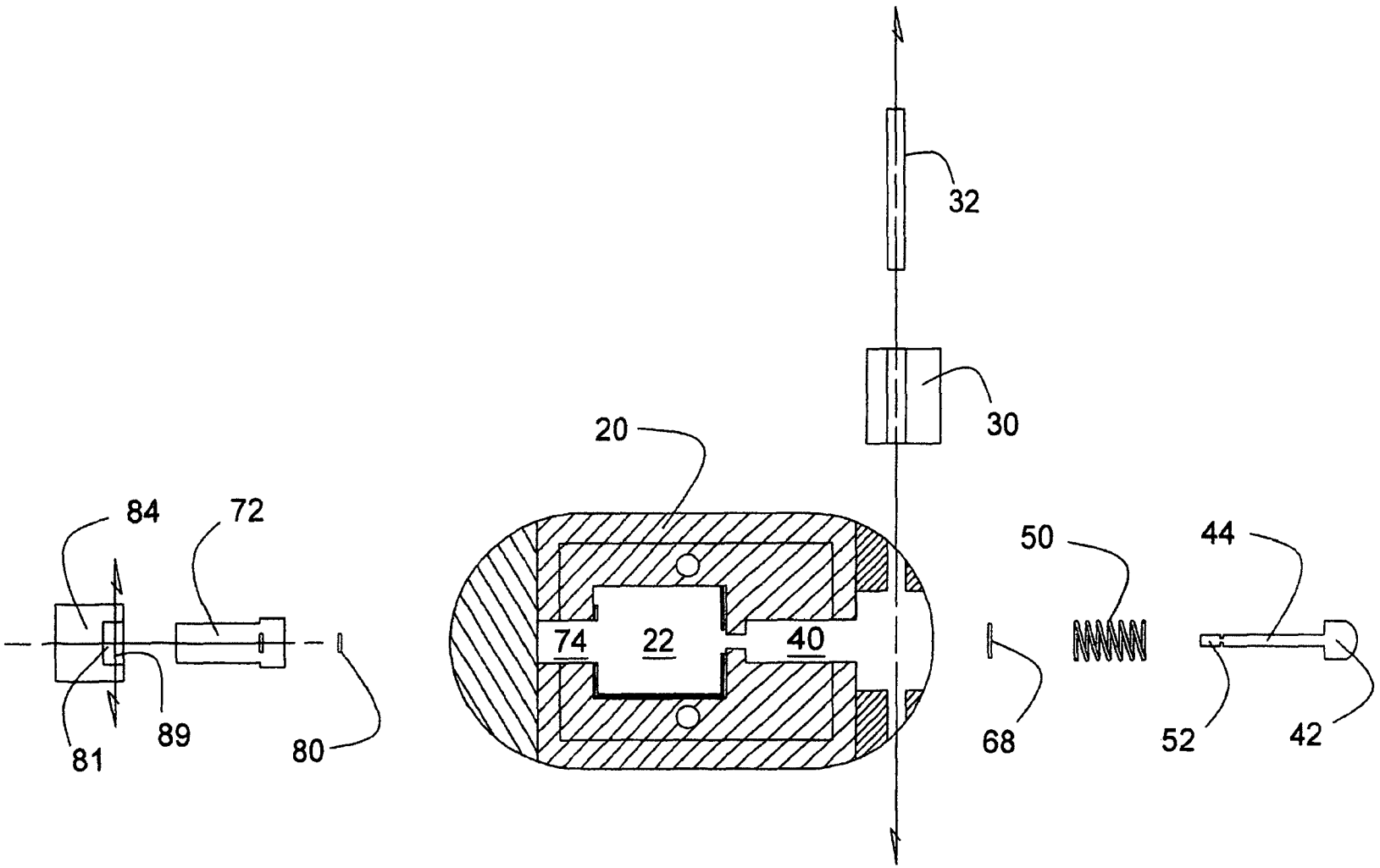
FIG. 11 is an unassembled view of the energy emission control switch assembly which is made in accordance with the teachings of the preferred embodiment of the invention and which is shown in FIGS. 1-10.
Figure 17:
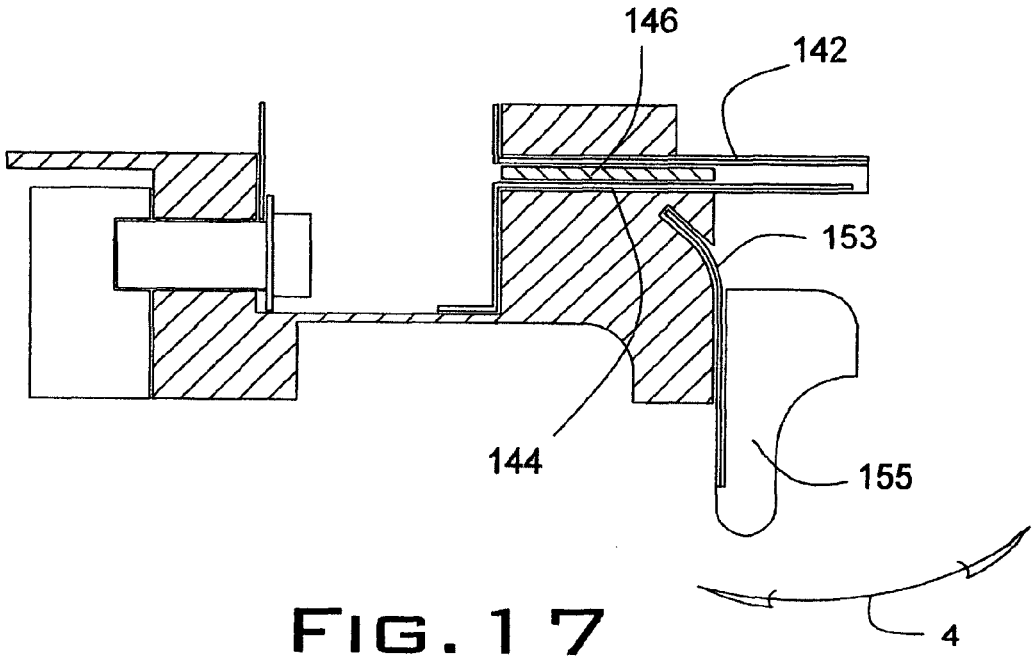
FIG. 17 is a top view of an energy emission control switch assembly which is made in accordance with the teachings of an alternate embodiment of the invention and which is shown in FIG. 16, but in which the switch is in the "off" or deactivated state.

The switch assembly portion 140 further includes a selectively movable lever member 155, which is attached to the body 20 by a leaf spring 153. A first end of leaf spring 153 is housed within groove 157 and a second end 156 is attached to the lever 155 and such attachment may be achieved by the use of glue or some other method or material. Thus, lever member 155 may selectively move or "flex" toward and away from end 152 of metallic strip 144 along arc 4, thereby connecting and disconnecting end 152 with end 150 (e.g., in a first position, as shown in FIG. 10), member 155 is forced to cause end 152 to physically contact end 150, thereby allowing power to be sourced from source 90 to assembly 14 through connected segments 24, 26, 27, and materials 80, 68 while in a second position (shown in FIG. 17), member 155 is moved out of contact with end 152 thereby disconnecting end 152 with end 150 and preventing the flow of power from source 90 to assembly 14.

In this non-limiting embodiment, the switch 140 is placed upon a weapon such as weapon 10, and the leaf spring 153 (i.e., the force exerted by the leaf spring 153 normally) causes lever member 155 to "squeeze" ends 150, 152 together in order to "complete a circuit". When the force is removed (e.g., directly by a hand of a user), by flexing lever member 155 away from end 152 along arc 4, conductive strip 142 is disconnected from conductive strip 144 causing the power flow to be interrupted. Thus, positive action is required by the user to disconnect or interrupt the power flow to the energy emitting assembly 14.

Figure 18:
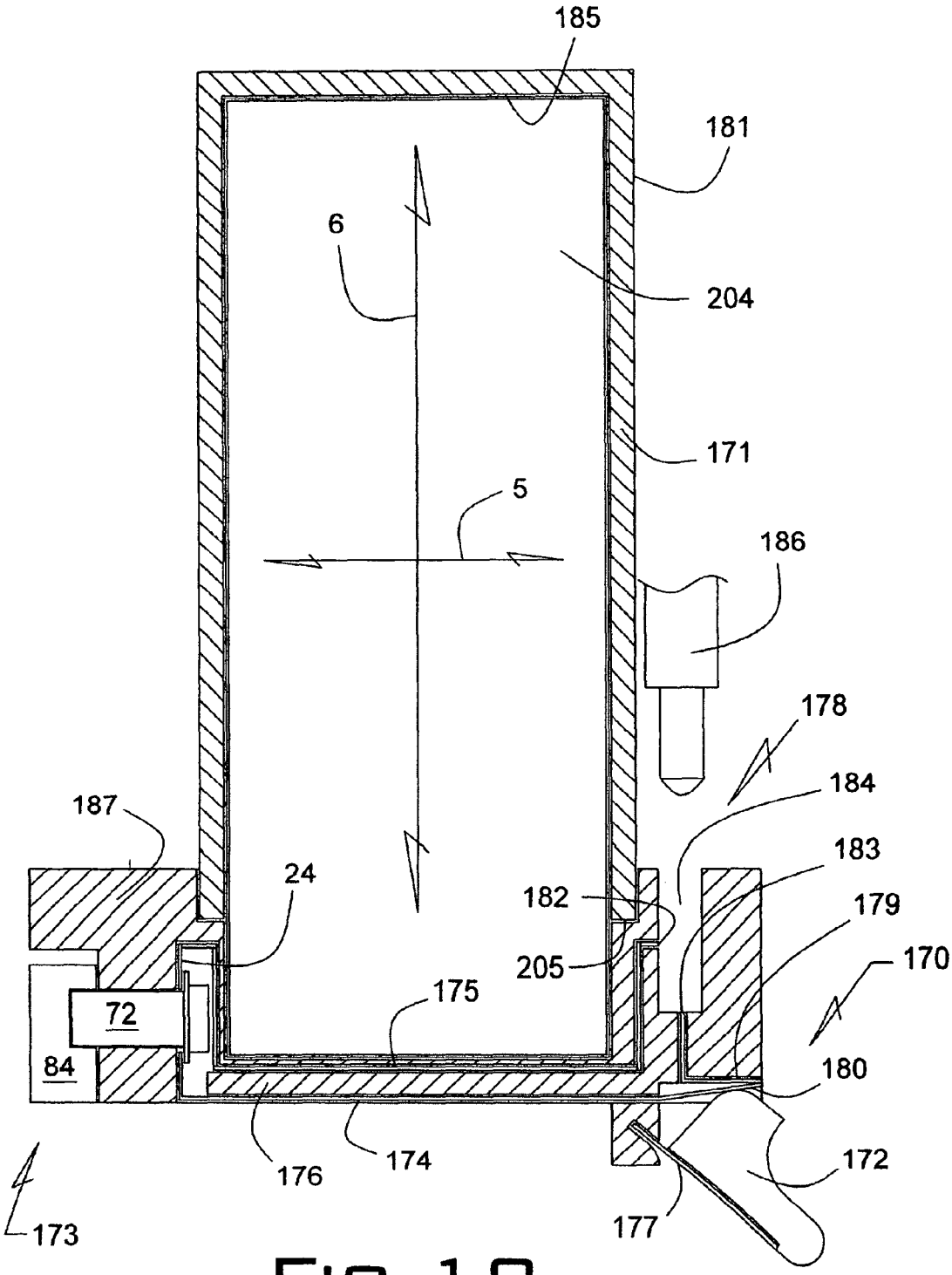
FIG. 18 is a top view of a switch assembly which is made in accordance with the teachings of an alternate embodiment of the invention and which is shown in the "on" or activated state.
Figure 19:
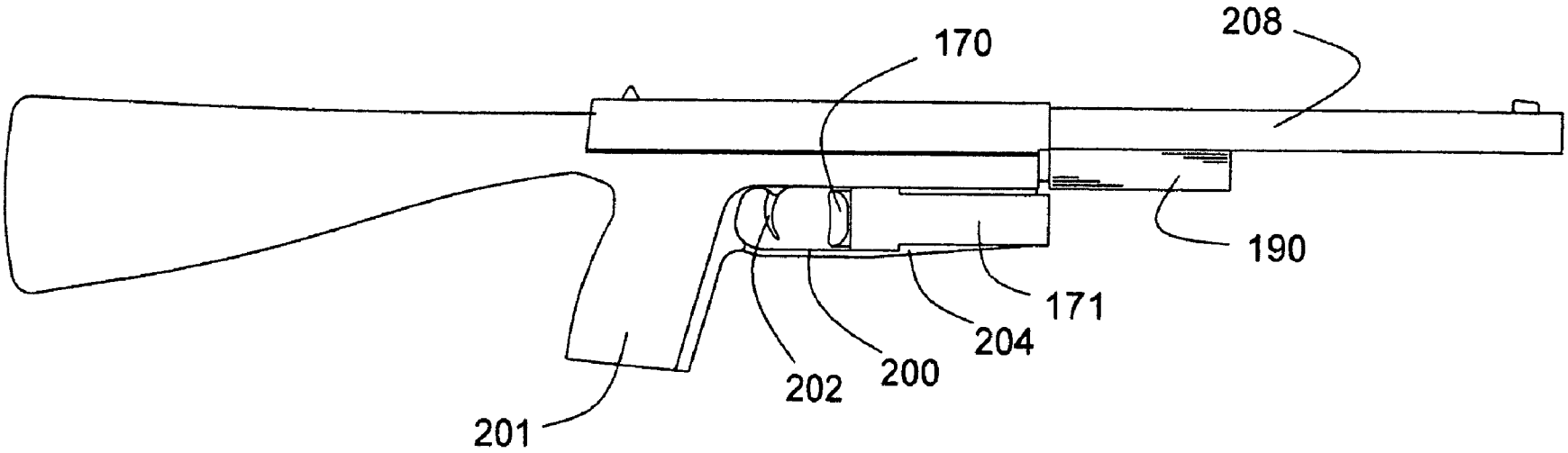
FIG. 19 is a side view of a weapon which includes an energy emission control switch assembly which is made in accordance with the teachings of an alternate embodiment of the invention, which is shown in FIG. 18, and which is being deployed proximate to the trigger of the rifle.

In other alternative and non-limiting embodiments as best shown in FIGS. 18 and 19, a mounting bracket 171 may be utilized to attach an energy emission control switch assembly 170 to a long-arm weapon (e.g. a rifle).

In one non-limiting embodiment, the energy emission control assembly 170 may comprise any of the foregoing energy emission control switch assemblies which have been discussed in combination with a new and novel bracket 171.

Particularly, mounting bracket 171 provides a way to attach the energy emission control switch assembly 170 to a magazine well 204 of a rifle 208 while allowing the assembly 170 to operatively control the delivery of power to energy assembly 180 in the manner previously delineated.

In one non-limiting embodiment, the mounting bracket 171 comprises a "U-shaped" body 173 and may be about 1.15 inches wide, along axis 5, and about 2.4 inches long, along axis 6. The mounting bracket 171 includes a generally flat surface 181 which may be selectively attached to surface 185 of magazine well 204 of rifle 208 by the use of screws or nylon strap or some other conventional method.

Due to this attachment, the open end 205 of bracket 171 faces the trigger 202 of rifle 208 and is adapted to frictionally and selectively receive body 20 of energy emission control switch assembly 170 and such body 20 may further be attached to the bracket 171 by the use of a screw or some other fastener assembly or method.

Thus, the bracket 171 fixedly positions the energy emission control switch assembly 170 proximate to the trigger portion 200 of the rifle 208 such that the selectively movable lever 172 is proximate to the trigger portion 200.

The bracket 171 provides advantageous features of allowing various types of other emission assemblies attached to a rifle to be selectively operated in an efficient and highly desired manner and allows these assemblies to be positioned in a fixed manner and at a desired position. It should be further appreciated that the mounting bracket can be manufactured from metal or molded plastic and can be adapted based on the particular rifle.

In another non-limiting embodiment as best shown in FIG. 18, the energy emission control switch assembly 170 may also include a selective and detachable connecting jack 178 formed in the body 187 of the energy emission control switch assembly 170 and which allows an energy emission source to be selectively and removably coupled to an energy emission control switch assembly 170. That is, conductive segment 174 is normally coupled to conductive segment 179, due to the normal biasing of end 180 against metallic segment 179 by the force exerted by the leaf spring 177 on lever 172. Additionally, disable switch is 173 is normally biased to make a connection between conductive segment 172 with conductive segment 174 through conductive member 80, and as best described in an earlier embodiment in the preferred embodiment. Moreover, conductive segment 175 terminates into cavity 184 at end 182 and conductive segment 179 terminates into cavity 184 at end 183. Thus, the placement of a conductive member 186 into cavity 184 allows the placed conductive member 186 to physically touch the exposed connectors 182, 183 and form a connection between connectors 172, 174, 179, 186, 175, and 80 and "complete a circuit" (e.g., the member 186 is also physically attached to an energy emission assembly 190) thus allowing the energy emission control assembly 170 to selectively and removably control an energy emission assembly 190. It should be appreciated that the energy emission control assembly 170 may comprise any of the foregoing energy emission control switch assemblies previously described and as best shown in FIGS. 5 and 16. Also, the conductive segment 175 can also be "hard-wired" or physically and electrically connected to conductive segment 179 at first surface 182 and second surface 183 so as to complete a circuit between conductive segment 174, 175 and conductive segments 180 and 179, thereby obviating the need for conductive member 186.

Thus, it should be appreciated that the foregoing inventions, in part, provide a switch assembly and a weapon which allows visible energy, such as light, to be emitted from the weapon without user intervention or the need for "positive action". The "normal state" of the foregoing energy emission assembly is therefore "on" or activated. It should further be appreciated that the foregoing described switch assemblies, such as switch assembly 60, may be adapted to selectively "control" (i.e., source electrical power) to a wide variety of dissimilar weapon mounted devices/assemblies. It should be further appreciated that switch 16, including disable switch portion 70, may be placed at substantially any convenient location upon the weapon 10 and that, in the most preferred although non-limiting embodiment, the disable switch portion 70 comprises a rotary movement.

In yet another non-limiting embodiment of the invention, it should be appreciated that any of the foregoing switch assembly embodiments may replace current switches used on long arms and crew served weapons when the device to be controlled is located some distance from the firing mechanism of the weapon.

It is to be understood that the inventions are not limited to the exact construction or methodology which has been described above, but that various changes and modifications may be made without departing from the spirit and the scope of the inventions as they are more fully delineated in the following claims.

What is claimed is:

1. A firearm having a projectile firing portion, which includes a trigger and a surface;

a selectively activatable energy emitter which is coupled to said projectile firing portion; a source of energy;

a switch portion which is coupled to said surface of said firearm and which includes a selectively movable lever positioned proximate to said trigger and which normally and orthogonally extends away from said barrel and which is movable from a first position to a second position and wherein said switch portion is coupled to said source of energy and to said energy emitter and when said selectively movable lever is in said first position, said source of energy is coupled to said emitter, thereby causing said emitter to generate visible energy and when said selectively movable lever is selectively moved to said second position, said coupling of said source of energy to said emitter is interrupted, thereby preventing said emitter from generating said visible energy, wherein said selectively movable lever is biased in a first direction toward said first position such that when the firearm is removed from a holster or other resting surface, the emitter immediately generates said visible energy and is thereafter prevented from generating said visible energy only if and only for so long as a force is applied to said selectively movable lever in a direction approximately opposite said first direction to overcome said bias; and a disable switch which is coupled to said switch portion and which prevents said energy emitter from being coupled to said source of energy regardless of the position of said lever.

2. The firearm of claim 1 wherein said source of energy comprises a source of electrical power.

3. The firearm of claim 1 wherein said energy emitter comprises a selectively energizable light.

4. The firearm of claim 1 wherein said energy emitter comprises a laser.

5. The firearm of claim 1 wherein said energy emitter comprises an electronic sighting device.

6. The firearm of claim 1, wherein the resting surface is a firearm container.

7. The firearm of claim 1, wherein the resting surface is a horizontal surface.

* * * * *